United States Patent [19]

Ikeuchi

[11] Patent Number: 4,765,302

[45] Date of Patent: Aug. 23, 1988

[54] CUT-OFF FUEL EXHAUST MECHANISM IN FUEL INJECTION PUMP

[75] Inventor: Hiroshi Ikeuchi, Higashimatsuyama, Japan

[73] Assignee: Diesel Kiki Co., Ltd., Tokyo, Japan

[21] Appl. No.: 46,552

[22] Filed: May 6, 1987

[30] Foreign Application Priority Data

Jul. 25, 1986 [JP] Japan ..... 61-114084[U]

[51] Int. Cl.[4] ..... F02M 37/04

[52] U.S. Cl. ..... 123/506; 123/449

[58] Field of Search ..... 123/506, 198 DB, 357-359, 123/449

[56] References Cited

U.S. PATENT DOCUMENTS

| | | | |
|---|---|---|---|
| 4,458,648 | 7/1984 | Braun et al. | 123/506 X |
| 4,546,749 | 10/1985 | Igashira et al. | 123/506 |
| 4,574,756 | 3/1986 | Ito et al. | 123/506 X |
| 4,583,508 | 4/1986 | Schechter | 123/506 X |
| 4,593,668 | 6/1986 | Yuzawa | 123/506 X |
| 4,612,893 | 9/1986 | Ishibashi et al. | 123/506 X |

*Primary Examiner*—William E. Tapolcal

*Attorney, Agent, or Firm*—Wenderoth, Lind & Ponack

[57] ABSTRACT

A cut-off fuel exhuast mechanism in a fuel injection pump comprises a pump housing which defines a pump house, a fuel passage communicating with the pump house formed in the housing, a plunger barrel secured to the pump housing and provided with an intake port opened up on its periphery and communicating with the fuel passage, and a pressurized chamber defined by a shaft end of a plunger which is pivotably and slidably contained in the plunger barrel and being able to communicate with the intake port, the plunger barrel being provided with an oil passage communicating with the pressurized chamber separately from the intake port, the pump housing being provided therein with an exhaust passage communicating with the pump house, the oil passage and exhaust passage being caused to communicate with each other at the end of fuel injection, cut-off fuel remained in the pressurized chamber being directly exhausted into the pump house and not via the fuel passage.

4 Claims, 1 Drawing Sheet

CUT-OFF FUEL EXHAUST MECHANISM IN FUEL INJECTION PUMP

FIELD OF THE INVENTION

This invention relates to an exhaust mechanism for cut-off fuel in a fuel injection pump which is capable of performing the fuel cut-off without failure.

DESCRIPTION OF THE PRIOR ART

Generally, cut-off fuel, which is exhausted when fuel being injected by a fuel injection pump into a diesel engine is cut-off, is high in pressure. Therefore, it is necessary to select a discharging passage for the cut-off fuel when it is exhausted into a pump housing so that other members are not adversely affected.

For example, Japanese utility model laid-open publication No. 60-133173 discloses an electromagnetic control system distribution type fuel injection pump in which a balance piston having a throttle for opening and closing the communicating passage between an intake port and a high pressure chamber is actuated by a pressure difference of the pilot flow at the front and back of the throttle and the cut-off fuel is exhausted to the intake port via a pilot portion which cuts off the communicating passage at the end of the injection.

However, the conventional pumps of this type have such shortcomings that since a low pressure side passage acting as an exhaust passage for cut-off fuel is opened up in the vicinity of fuel cut-off solenoid, the high pressure cut-off fuel moves around a rubber valve of the fuel cut-off solenoid every time the injection of the cut-off fuel into each cylinder of the engine is over, which increases the deterioration and breakage of the valve and the engine becomes unable to stop due to the poor sealing off of fuel.

SUMMARY OF THE INVENTION

The present invention was made in order to overcome the above-mentioned shortcomings.

It is therefore an object of the present invention to provide a cut-off fuel exhaust mechanism in a fuel injection pump in which a flow-out passage for cut-off fuel is separately provided from a fuel intake passage and the cut-off fuel is directly exhausted into a pump housing thereby to prevent the deterioration of a rubber valve by the cut-off fuel and to improve the reliability of this type of pump.

Another object of the invention is to provide a cut-off fuel exhaust mechanism in a fuel injection pump in which the fuel cut-off is performed without failure when the engine is stopped so that the engine is stopped without failure, thereby to ensure its safety.

The cut-off fuel exhaust mechanism in a fuel pump according to the present invention is characterized in that an oil passage communicating with a pressurized chamber is formed in a plunger barrel and an exhaust passage formed in a pump housing which is able to communicate with the oil passage is open into the pump housing so that cut-off fuel is directly exhausted into the pump housing and not via a fuel intake passage.

The above objects, features and advantages of the present invention will become more apparent to those skilled in the art from a reading of the following detailed description of the invention in conjunction with the accompanying drawing.

DETAILED DESCRIPTION OF PREFERRED EMBODIMENT

Figure 1:
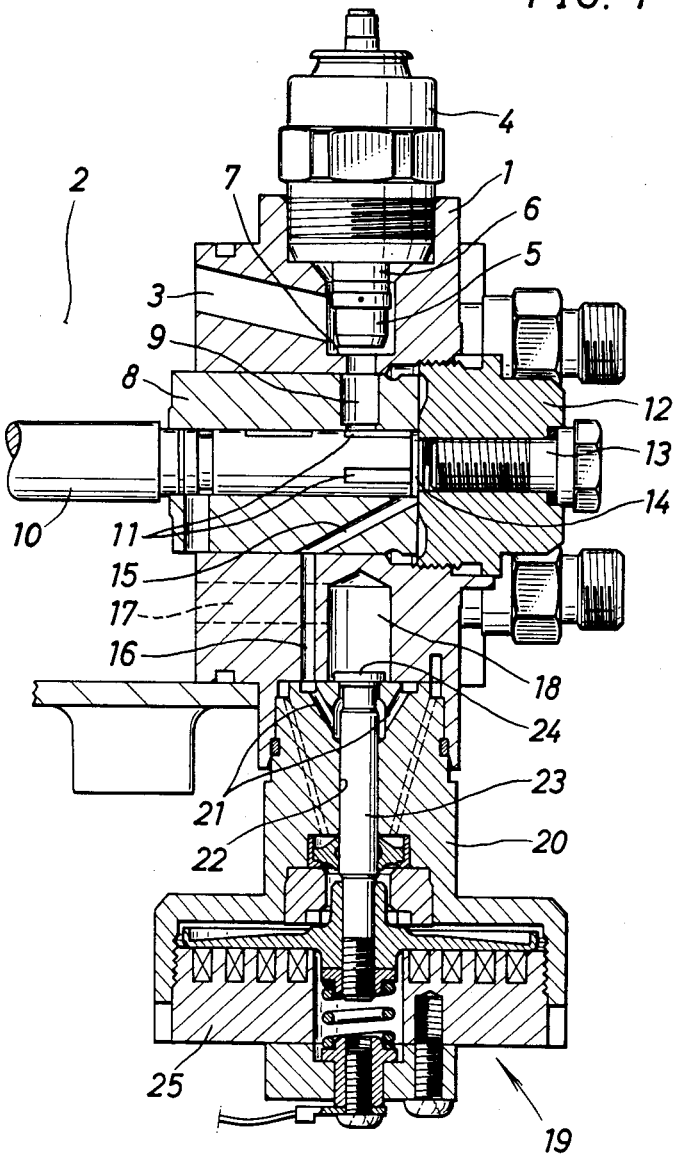
FIG. 1 is a sectional view showing one embodiment of the present invention.

One preferred embodiment of the present invention will be described with reference to FIG. 1, in which the present invention is applied to a distribution type fuel injection pump which is equipped with an electromagnetic valve which is capable of adjusting the quantity of injection fuel. In FIG. 1, 1 denotes a pump body which is within a pump space 2 in a pump housing in which a slant fuel passage 3 communicating with the pump pace 2 is formed. A fuel cut-off solenoid 4 is disposed adjacent to the passage 3.

The fuel cut-off solenoid 4 is energized while the engine is in operation, and pulls up an anchor 6 having a rubber valve 5 attached at its lower end and opens the fuel passage 3. On the other hand, the solenoid 4 is deenergized when the engine is stopped and the anchor 6 is urged downwards by a spring (illustration omitted) contained therein, and urges the valve 5 against a valve seat 7 to close the fuel passage 3.

A hollow plunger barrel 8 is secured to the pump body 1 adjacent to the fuel passage 3. The barrel 8 is formed at its shaft end portion with an intake port 9 communicating with the fuel passage 3. Within the plunger barrel 8, one end of the plunger 10 is pivotably and slidably positioned. The shaft end portion of plunger 10 is formed with a plurality of intake slits 11 extending in the axial direction on the periphery thereof and communicating with the intake port 9.

The intake slits 11 are communicated with a pressurized chamber 14 which is defined by an end face of the plunger 10 and an end face of a threaded shaft of an adjusting bolt 13 which forms an internal end portion of a head plug 12 secured to the pump body 1. A slant oil passage 15 communicating with the pressurized chamber 14 opens from the periphery of the plunger barrel 8 opposite the intake port 9.

Within the pump body 1 facing the end of the oil passage 15, are provided a lead hole 16 communicating with the oil passage 15, an exhaust passage 17 open at its one end in the pump space 2, and an oil chamber 18 having a comparatively large capacity and communicating with the exhaust passage 17. Of these, the lead hole 16 and oil chamber 18 are closed at the open end portions with a valve housing 20 of an electromagnetic valve 19 which is able to adjust the quantity of the injection fuel. Within the valve housing 20 are provided slant induction holes 21 communicated with the lead hole 16 and a guide hole 22 communicating with the holes 21. Within the guide hole 22, a valve shaft 23 is slidably contained. Guide hole 22 has an enlarged portion **22*a* extending from the ends of slant holes 21 to the end of valve housing 20 facing oil chamber 18**.

One end of the valve shaft 23 is integrally provided with a valve member 24 for closing enlarged portion **22*a*, whereby the induction holes 21 and oil chamber 18 are able to be connected with and disconnected from each other. More specifically, the valve member 24 is normally held in its opened-state to permit the induction holes 21 and oil chamber 18 to communicate with each other, and is closed at a desired injection time which is decided by the load on the engine and the speed of rotation, etc. through a solenoid which will be described hereinafter to cut off the communication between the induction holes 21 and oil chamber 18. The valve member 24 is opened when a desired quantity of injection fuel, which is decided by a load on the engine and the speed of rotation, etc., is reached to cause the end of the injection and reopen the communication between the induction holes 21 and oil chamber 18**.

In the FIGURE, 25 denotes a solenoid adapted to control the opening and closing action of the valve member 24, which is controlled by a controller (not shown) which intakes various information such as load on the engine and the speed of rotation, processes the information and outputs a drive signal to the solenoid at the best time.

In the mechanism constituted as described above according to the present invention, the fuel cut-off solenoid 4 is deenergized when the engine is stopped, the anchor 6 is urged downwards by the spring contained therein, and the valve 5 mounted on the lower end of the anchor 6 is urged against the valve seat 7 to cut off the communication between the fuel passage 3 and the intake port 9. The electromagnetic valve 19 is also deenergized and the valve shaft 23 is urged upwards. As a result, the valve by spring 26 body 24 situated at the upper end of the shaft 23 is separated from the edge of the opening of the guide hole 22 and opened, and the oil chamber 8 and induction hole 21 are communicated with each other.

Under such circumstance, when the engine is started and the fuel cut-off solenoid 4 is energized, the anchor 6 is pulled up, and the valve 5 rigidly formed with the anchor 6 is separated from the valve seat 7 and opened. Accordingly, fuel oil filling in the pump space 2 is guided into the intake port 9 from the fuel passage 3 and taken into the pressurized chamber 14 and plunger 10 via the intake slit 11 of the plunger 10 which starts its rotation and reciprocal movement almost simultaneously with the engine start.

In this case, a part of the fuel oil guided into the pressurized chamber 14 flows into the induction holes 21 via the oil passage 15 and lead hole 16. On the other hand, the oil chamber 18 is filled with fuel oil which flows therein from the pump space 2 via the exhaust passage 17.

In this way, when the intake port 9 is closed during the rotary displacement of the plunger 10, the plunger 10 is driven into the plunger barrel 8 to pressurize the intake fuel. A drive signal is outputted from the control unit to the solenoid 25 at a desired injection time which is decided by the load on the engine, the speed of rotation, etc. in this injection process, the solenoid 25 is energized to attract the valve shaft 23 and the valve body 24 is seated. Accordingly, fuel oil in the pressurized chamber 14 is pressurized to a high pressure, reaches the delivery valve (not shown) passing through the plunger 10 to push the delivery valve to open it, and is transferred into the combustion chamber of the engine under pressure.

In this way, when a desired quantity of injection fuel which is decided by load on the engine, the speed of rotation, etc. is obtained after the fuel injection into the combustion chamber is started, a control signal is outputted from the control unit to the solenoid 25 again to deenergize the solenoid 25. Due to the foregoing, the valve shaft 23 is moved upwards to open the valve body 24 and the pressure in the pressurized chamber 14 is dropped to stop the transference of the fuel into the combustion chamber of the engine. Thus, the fuel injection is over.

Accordingly, the high pressure cut-off fuel remaining in the pressurized chamber 14 is guided into the induction holes 21 from the oil passage 15 via the lead hole 16, passes through the enlarged portion of the guide hole 22 past valve body 24 and flows into the il chamber 18. The pressure loss in the cut-off fuel is increased and the pressure reduced while it moves along these bent flow passages and flows into the oil chamber 18 having a comparatively large capacity, thereby to further enhance the pressure drop.

In this way, the cut-off fuel the pressure drop of which is increased is further guided into the exhaust passage 17 from the oil chamber 18 and exhausted into the pump space 2. In this case, since the oil chamber 18 and exhaust passage 17 are filled with fuel oil as mentioned, the pressure of the cut-off fuel is also reduced by these. Furthermore, since the series of exhaust passages for the cut-off fuel are very long because of the provision of the exhaust passage 17 in addition to the bent passages, the pressure of the fuel oil is further reduced by flow resistance.

Accordingly, even if such cut-off fuel is exhausted into the pump space 2, there is no worry that dust floating in the oil in the pump space 2 and dust deposited on the bottom portion thereof are lifted by the exhaust flow and taken into the plunger 10. Moreover, the cut-off fuel does not flow out into the fuel passage 3. Instead, another exhaust passage separated from the passage 3 is employed as also described. Accordingly, the valve 5 is not exposed to the cut-off fuel and is not deteriorated contrary to the prior art. Accordingly, the valve 5 has a long life, fuel is cut off without failure when the engine is stopped, and safety is ensured.

As described in the foregoing, a cut-off fuel exhaust mechanism in a fuel injection pump according to the present invention comprises a pump body in a pump space, a fuel passage communicating with the pump space formed in the housing, a plunger barrel secured to the pump body and provided with an intake port on its periphery and communicating with the fuel passage, and a pressurized chamber defined by a shaft end of a plunger which is pivotably and slidably contained in the plunger barrel and able to communicate with the intake port, the plunger barrel being provided with an oil passage communicating with the pressurized chamber separately from the intake port, the pump body being provided therein with an exhaust passage communicating with the pump space, the oil passage and exhaust passage being caused to communicate with each other at the end of fuel injection, cut-off fuel remaining in the pressurized chamber being directly exhausted into the pump house rather than by the fuel passage. Accordingly, the oil sealing valve provided in the fuel intake passage is prevented from being broken and deteriorated by the cut-off fuel and its long life is assured. In addition, the fuel cut-off can be performed by the valve without failure. Thus, safety can be improved when the engine is stopped.

What is claimed is:

1. A fuel injection pump having an exhaust means for exhausting fuel from the fuel pump at the time of cut-off of fuel flow through the pump, comprising:

a pump body for positioning in a pump space for containing fuel to be pumped, said pump body having a fuel passage extending thereinto from said pump space and a valve means in said fuel passage;

a plunger barrel mounted in said pump body and having a plunger bore therein and a fuel intake port extending through said plunger barrel from a position opposite the inner end of said fuel passage into said plunger bore;

a plunger rotatably and slidably mounted in said plunger bore and defining a pressurizing chamber at the inner end of said plunger bore;

said plunger barrel having an oil passage extending from the end within which said pressurizing chamber is defined to the periphery of said plunger barrel;

said pump body having a lead hole therethrough from a position opposite the end of said oil passage at the periphery of said plunger barrel to the outside of said pump body, and further having an oil chamber extending thereinto from a position on said pump body near the end of said oil passage and an exhaust passage extending from the inner part of said oil chamber to the outside of said pump body and opening into the pump space;

a valve housing mounted on said pump body over the end of said lead hole and the opening into said oil chamber and having a valve guide hole therein opening into said oil chamber and having a valve seat around the end thereof and having an oil induction hole therethrough from a position opposite the end of said lead hole and into said valve guide hole; and a valve member movably mounted in said guide hole having a valve body on the end thereof for being seated against said valve seat for closing said valve guide hole and for being moved off said valve means for opening said valve guide hole, and valve member actuating means for actuating said valve member in accordance with the pumping of fuel and the cutting off of fuel by the fuel pump, said oil passage, said lead hole, said oil induction hole, said valve guide hole, said oil chamber and said exhaust passage forming an exhaust path for fuel from said pressurizing chamber to the pump space for reducing the pressure of the fuel as it passes along said path, whereby when it is discharged into the pump space from said exhaust passage it will not agitate the fuel in the pump space.

2. A fuel injection pump as claimed in claim 1 in which said exhaust path is a generally loop-shaped path extending from said pressurizing chamber toward the pump space generally in the same direction as said pump plunger, and then away from said pump plunger and back toward said pressurizing chamber and then back toward the pump plunger and then toward the pump space.

3. A fuel injection pump as claimed in claim 2 in which said oil passage, said lead hole, said oil induction hole, said valve guide hole, said oil chamber and said exhaust passage are at angles to each other to form said loop-shaped path.

4. A fuel injection pump as claimed in claim 1 in which said oil chamber has a capacity which is large as compared to the capacity of said oil passage, said lead hole and said induction hole.

* * * * *